United States Patent [19]

Akczinski, Sr.

[11] 4,186,634

[45] Feb. 5, 1980

[54] SLICING MACHINE CLEANING GUARD

[76] Inventor: Joseph Akczinski, Sr., 317 Shipley Ave., Glen Burnie, Md. 21061

[21] Appl. No.: 946,315

[22] Filed: Sep. 27, 1978

[51] Int. Cl.[2] ..... B26D 7/22

[52] U.S. Cl. ..... 83/478; 83/545; 83/701

[58] Field of Search ..... 83/397, 478, 545, 860, 83/713

[56] References Cited

U.S. PATENT DOCUMENTS

| | | | |
|---|---|---|---|
| 2,573,860 | 11/1951 | Meeker et al. | 83/478 X |
| 2,619,142 | 11/1952 | Ditting | 83/478 |
| 3,821,918 | 7/1974 | Niehaus et al. | 83/478 X |
| 3,913,437 | 10/1975 | Speer et al. | 83/478 |
| 4,070,941 | 1/1978 | Lorenz | 83/397 X |

*Primary Examiner*—James G. Smith

*Attorney, Agent, or Firm*—Morton J. Rosenberg

[57] ABSTRACT

A slicing machine cleaning guard (16) mounted to a rotary blade front surface (22) of a slicing machine (10) in order to aid a user in cleaning the rear surface (20) of a rotary slicing blade (12). The slicing machine cleaning guard (16) is mounted to the slicing machine (10) subsequent to use. The slicing machine cleaning guard (16) includes a rotary blade cover element (14) which is mounted to the slicing blade frontal cutting surface (22) in contiguous and mating interface throughout the area of the blade front surface (22). The cover element (14) extends beyond a cutting edge (28) of the slicing blade (12) throughout the entire circumference of the periphery of the slicing blade (12). Additionally, securement mechanisms (34 and 44) are provided to secure the rotary blade cover element (14) to a housing (32) of the slicing machine (10).

10 Claims, 7 Drawing Figures

SLICING MACHINE CLEANING GUARD

BACKGROUND OF THE INVENTION

1. Field of the Invention

This invention relates to safety devices. In particular, this invention relates to safety devices for slicing machine systems. More in particular, this invention pertains to slicing machine cleaning guards which are mounted on a frontal surface of slicing blades for permitting cleaning of the rear surfaces of the blades. Still further, this invention relates to slicing machine cleaning guards formed in a disk-like contour which are removably securable to a frontal face of slicing blades of a slicing machine. Still further, this invention is directed to a slicing machine cleaning guard which is substantially planar in geometrical contour and matingly interfaces with a slicing blade in order to allow a user to clean the rear surfaces of the slicing blades without impingement on a blade edge. Additionally, this invention relates to a slicing machine cleaning guard which is threadedly securable to the housing of a slicing machine.

2. Prior Art

Safety devices to prevent injury to a limb of a user of a cutting machine utilizing rotary blades are well-known in the art. The best prior art known to Applicant includes U.S. Pat. Nos. 745,516; 3,811,355; 2,573,860; 2,052,366; 2,619,142; 2,398,409; 4,070,941; and, 3,880,032. In general, safety devices of this nature are directed to providing an injury free atmosphere during the cutting operation. Thus, such prior art devices are generally directed to cover elements for rotary blades which cover only a segment of the periphery of the blades. In such prior art devices, the blade protrudes from the guards in order that a cutting operation may take place. Thus, such guards are generally not adaptable for use in a cleaning operation where the appendage of the user must pass over the entire blade surface.

Further, in some prior art guard systems, the guards are not in contiguous contact with the slicing blade surfaces. If a user were to try to clean the blade with the guard in place in such systems, the user's digits may be inserted between the guard and the blade with deleterious effects to the user.

SUMMARY OF THE INVENTION

A slicing machine cleaning guard to aid a user in cleaning the rear surfaces of a rotary slicing blade. The rotary slicing blade has a substantially planar frontal cutting surface, and is adapted for rotary displacement with respect to a housing of the slicing machine. The machine cleaning guard includes a rotary blade cover element which is mounted to the slicing blade frontal cutting surface in a contiguous interface throughout the frontal surface. The cover element extends beyond a cutting edge of the slicing blade throughout an entire circumference of the cutting blade. The slicing machine cleaning guard further includes a mechanism for securing the rotary blade cover element to the housing of the slicing machine.

An object of the instant invention is to provide a slicing machine cleaning guard which is adapted for use in cleaning the rear surfaces of a rotary cutting blade subsequent to operation of the slicing machine.

Another object of the subject invention is to provide a slicing machine cleaning guard which is releasably mountable to the frontal surface of a slicing blade.

A still further object of the present invention is to provide a slicing machine cleaning guard having a cover element which is mounted in an interfacing and contiguous manner to a frontal surface of a rotary blade.

A still further object of the invention is to provide a cover element with extends beyond the periphery of a rotary cutting blade throughout the circumference of the cutting blade.

Another object of the invention is to provide a cover element which does not have a substantial cleanrance between the rotary blade cutting edge and the planar surface of the cover element.

A still further object of the subject invention is to provide a cover element for a slicing machine cleaning guard which is substantially transparent in order that the user may visually see the rotary cutting blade during a cleaning operation.

Another object of the instant invention is to provide an improved mechanism for securing the rotary blade cover element to a housing of the slicing machine.

DESCRIPTION OF THE PREFERRED EMBODIMENTS

Figure 1:
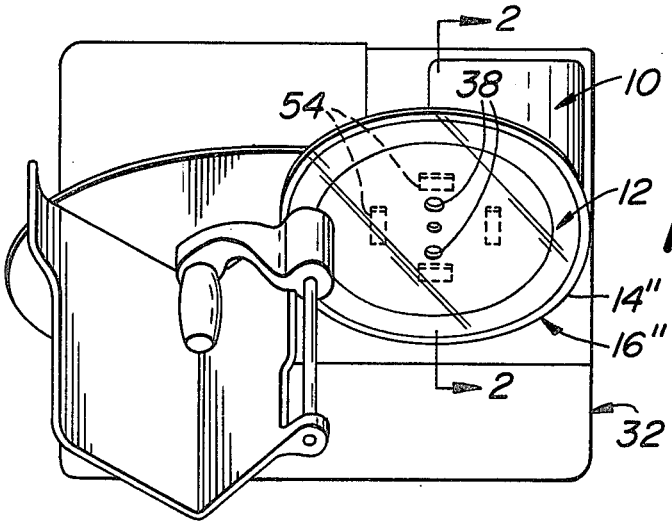
FIG. 1 is a perspective view of the slicing machine showing one embodiment of the slicing machine cleaning guard attached to a rotary slicing blade.

Referring now to FIGS. 1–7, there is shown a preferred embodiment of slicing machine cleaning guard 16, as well as cleaning guard embodiments 16' and 16'', to aid a user in cleaning slicing blade 12 of slicing machine 10. In general, slicing machine 10 may be one of a number of standard, commercially available machines produced by such companies as the Berkle Company, the Hobart Company, or one of numerous other companies producing slicing machines of the type or similar type as shown in FIG. 1. In particular, slicing machine 10 may be utilized for the layered slicing of meats, or other like material. In commerce, it has been found that one area of safety concern is in the cleaning of slicing blade 12 subsequent to use in the cutting of products. In particular, there has been found a problem in the cleaning of the rear surfaces of slicing blade 12. Apparently, when cleaning frontal surfaces of slicing blade 12, the user is able to visually see the surface which is being cleaned. However, when cleaning the rear surfaces, the user is placed in an unorthodox position and generally does not visually see the surface which is being cleaned. Thus, there has been a series of injurious accidents when the user's limb comes in contact with cutting edge 28 of slicing blade 12.

In general, slicing machine 10 includes a rotating shaft 18 which is formed in one piece formation or otherwise fixedly secured through bolts or some like mechanism to slicing blade 12. Thus, rotational displacement of shaft 18 results in a corresponding rotational activation of slicing blade 12, as is clearly seen in FIGS. 2, 4 and 6.

Slicing blade 12 includes blade rear surface 20, as well as blade front surface 22. Frontal surface 22 includes blade front surface cutting section 24 and blade front surface recessed portion 26. As will be seen in following paragraphs, preferred embodiment cover element 14, as well as other embodiment cover elements 14' and 14" are mounted adjacent to blade front surface 22 and in contiguous mating positional location with respect to blade front surface cutting section 24. As is seen in FIGS. 1, 2, 4, and 6, slicing blade 12 is generally circular in contour, when taken with respect to a vertical cross-sectional view. The circular contour of various slicing blades 12 is further seen in FIGS. 3, 5, and 7. As is evident, slicing machine 10 is generally placed on a rigid base surface, such as a table, and includes an overall housing 32 which remains stationary during all operations of slicing machine 10. Thus, shaft 18 and slicing blade 12 acting responsively and coincidentally with rotation of shaft 18 are activated with respect to housing 32 of slicing machine 10.

Figure 4:
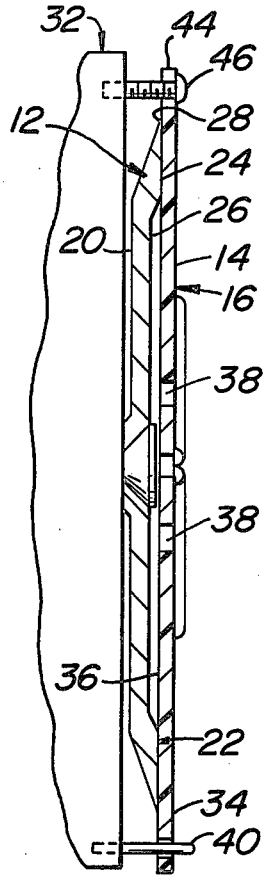
FIG. 4 is a elevational cross-sectional view of the preferred embodiment of the slicing machine guard showing further securement of a rotary blade cover element to a rotary blade of the slicing machine.

Slicing machine cleaning guard 16, as shown in FIG. 4, includes rotary blade cover element 14 which is mounted to slicing blade 12 on frontal surface 22 in contiguous interface with blade front surface cutting section 24. As can be seen, cover element 14 extends beyond cutting edge 28 of slicing blade 12 throughout an entire circumference of cutting or slicing blade 12.

Cover element 14 is generally planar in contour for mating interface with blade front surface 22 within blade front surface cutting section 24. For ease in mounting, cover element 14 is substantially formed in a disk like contour including a diameter greater than the diameter of rotary slicing blade 12 in order that there be provided an extension section of cover element 14 beyond blade cutting edge 28 at all points in the peripheral circumference area of edge 28. An important aspect of the subject invention concept, is that cover element rear surface 36 lie contiguous and in mating interface with blade front surface cutting section 24. Thus, as can be seen, when cleaning blade rear surface 20, the user cannot come in contact with a sharpened edge, such as blade cutting edge 28.

Each of slicing machine cleaning guards 16, 16', and 16", are formed of a substantially transparent material. In general, in certain art, the particular type and visual display of elements may not be important, however, in this art, the user should be able to see clearly slicing blade 12 through cover element 14. Further, cover element 14 may generally be formed of a plastic material type composition for ease of mounting on slicing blade 12. Additionally, plastic type material of this nature is not brittle and subject to cracking, as may be the case if the user were to be use a material formed of silicon-oxide or some like brittle composition. In cover element 14, there is provided a pair of holes 38 formed through cover element 14, for insert of a digit of a user to aid in removal and mounting of cover element 14 to and from slicing blade 12. Passages or openings, or holes 38 aid in maintaining the fingers of a user out of the area of cutting edge 28 of slicing blade 12 when mounting or demounting cover element 14 from slicing blade 12. In general, openings 38 are off-axis from cover element 14 in order to allow the user to manipulate cover element 14 in a coincident axis mounting on slicing blade 12. Upon mounting, cover element 14 has a coincident axis with shaft 18 and slicing blade 12, as is clearly seen in FIGS. 3, 5, and 7. Although the particular locations of openings 38 are not highly critical to the inventive concept as is herein described, such openings are generally within the span width of a user's hand in order that two digits may be inserted through openings 38 for mounting and demounting purposes. Such displacement of openings 38, each when taken with respect to the other, approximates four inches.

Figure 5:
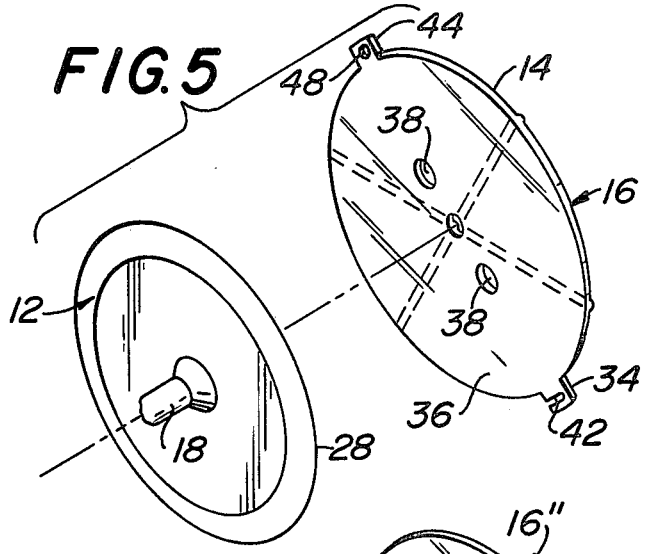
FIG. 5 is a perspective partially exploded view of the cover element and the rotary blade for the embodiment provided in FIG. 4.

Slicing machine cleaning guards 16, 16', and 16" envisage mechanisms for securing rotary blade cover elements 14, 14', 14" to slicing machine housing 32 of slicing machine 10. In the preferred embodiment as shown in FIGS. 4 and 5, the mechanism for securing rotary blade cover element 14 includes slot insert member 34 which is fixedly secured to cover element 14 either in one piece formation or through bolts, screws, or some like mechanism. Slot insert member 34 extends outwardly in a radial direction from the periphery of cover element 14, as is shown in FIG. 4. Slot insert member 34 is adapted for insert of extension lug member 40, extending outwardly from housing 32 of slicing machine 10. Extension of lug 40 is generally an integral part of various types of meat slicing machines, such as that produced by the Berkle Company, and utilized for insert within a slot provided on a machine cutting guard, utilized during machine operation. Extension lug member 40 is insertable within slot 42 to provide some constrainment between housing 32 and cover element 14. Additionally, threaded securement member 44 is also fixedly mounted to a periphery of cover element 14 and is segmentally displaced with respect to slot insert member 34. Securement member 44 is coupled to a threaded opening formed in machine housing 32 of slicing machine 10. Thus, bolt member 46 which is threaded, may be passed through opening 48 in securement member 44 and inserted into threaded opening formed in machine housing 32. Tightening of bolt 46 on securement member 44 provides a fixed constrainment between cover element 14 and slicing blade 12.

Figure 6:
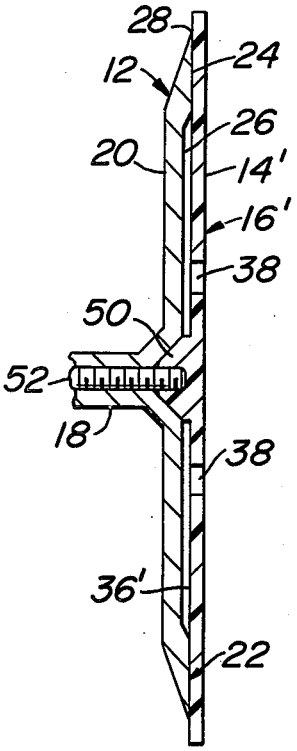
FIG. 6 is a sectional elevational view of another embodiment of the slicing machine cleaning guard, showing a threaded securement mechanism for attaching the cover element to the housing of the slicing machine; and, FIG. 7 is a perspective partially exploded view of the embodiment shown in FIG. 6, providing for the rotary blade cover element and the rotary blade of the slicing machine.
Figure 7:
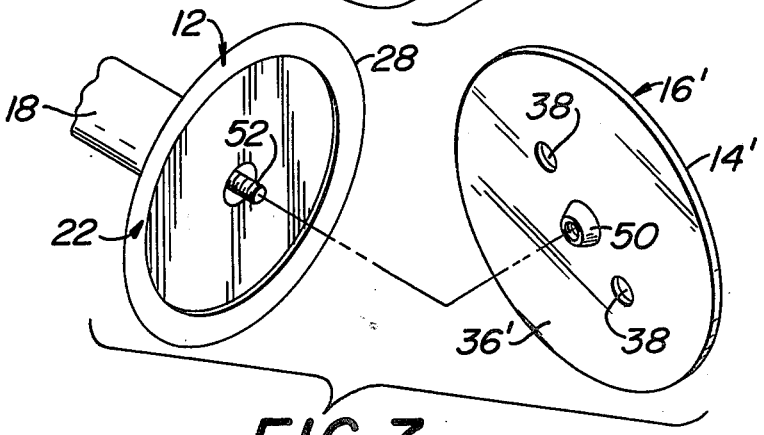

In another embodiment of slicing machine cleaning guard 16', as provided in FIGS. 6 and 7, cover element 14' includes threaded bushing member 50 formed on rear surface 36'. Threaded bushing 50 extends in a rearward direction with respect to cover element rear surface 36' and is generally positioned in an axially coincident manner with respect to the overall axis of cover element 14'. Threaded bushing member 50 is adapted for insert into the volume provided by blade front surface recessed portion 26. Additionally, threaded bolt 52 passing external to shaft 18 engages threaded bushing 50 in threaded securement. Bolt 52 is generally found on particular commercial slicing machines 10, such as the Hobart type slicing machine. Thus, the fixed securement in this embodiment is provided by the engagement of threaded bushing 50 with bolt 52 passing external to shaft 18 and in fixed securement therewith, as is standard in the commercially available slicing machines.

Figure 2:
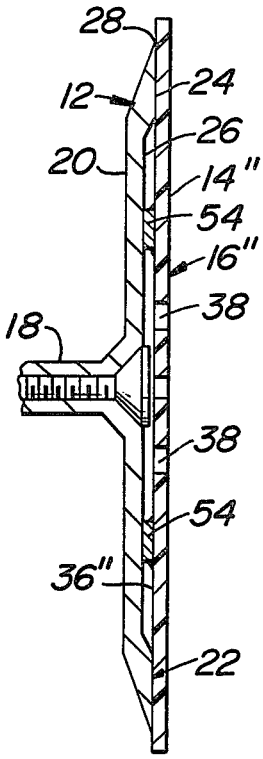
FIG. 2 is a sectional view of one embodiment of the slicing machine cleaning guard taken along the section lines 2—2 of FIG. 1.
Figure 3:
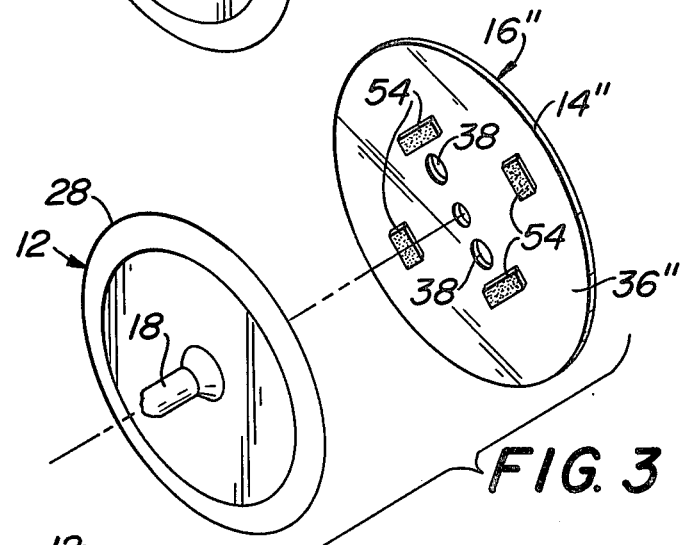
FIG. 3 is a perspective view of a rotary blade cover element showing a rotary blade cover element and a rotary blade exploded each from the other, providing magnetic securing means as provided in the embodiment of FIG. 2.

In a further embodiment, as provided in FIGS. 2 and 3, slicing guard 16″ is mounted to rotary blade 12 by one or a plurality of magnet members 54 which are mounted in fixed securement to rear surface 36″ of cover element 14″. Magnet members 54 have a width approximately equal to the width provided by the space of front blade surface recessed portion 26 and rear surface 36″ of cover element 14″. In this manner, there is provided a releasable type securement mechanism between cover element 14″ and blade 12.

In operation, whether the user utilizes the preferred slicing machine cleaning guard 16, or embodiments 16′ or 16″, the user initially operates slicing machine 10 for slicing materials thereon. Subsequent to use, the user may remove the slicing machine guard if such is provided with the particular slicing machine 10 being utilized. Cover elements 14, 14′ or 14″ are inserted and secured to slicing blade 12. The user may then clean the rear surface of slicing blade 12 without any possibility of injuring himself or herself during the manual cleaning operation. This is provided due to the fact that cover elements 14, 14′, or 14″ are in mating interface with cutting edge 28 of slicing blade 12. Thus, there is substantially no clearance provided for edge 28 to come in contact with the body of the user.

Although this invention has been described in connection with specific forms and embodiments thereof, it will be appreciated that various modifications other than those discussed above may be resorted to without departing from the spirit or the scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A slicing machine cleaning guard to aid a user in cleaning the rear surfaces of a rotary slicing blade having a substantially planar frontal cutting surface, said rotary slicing blade adapted for rotary displacement with respect to a housing of said slicing machine, wherein the improvement comprises:

(a) a rotary blade cover element mounted to said slicing blade frontal cutting surface in contiguous interface throughout said frontal surface, said cover element extending beyond a cutting edge of said slicing blade throughout an entire circumference of said cutting blade; and, (b) means for securing said rotary blade cover element to said housing of said slicing machine.

2. The slicing machine cleaning guard as recited in claim 1 where said cover element is substantially planar for mating interface with said slicing blade frontal surface.

3. The slicing machine cleaning guard as recited in claim 2 where said cover element is substantially formed in a disk like contour, said cover element disk having a diameter greater than a diameter of said rotary slicing blade.

4. The slicing machine cleaning guard as recited in claim 3 where said cover element is formed of a substantially transparent material.

5. The slicing machine cleaning guard as recited in claim 4 where said cover element is formed of a plastic material composition.

6. The slicing machine cleaning guard as recited in claim 1 where said cover element includes at least one opening formed therethrough for insert of a finger of a user to aid in removal of said cover element from said slicing blade.

7. The slicing machine cleaning guard as recited in claim 1 where said means for securing said rotary blade cover element includes a threaded bushing member fixedly secured to said cover element, said bushing member for threadedly engaging a threaded slicing machine shaft extending from said housing of said slicing machine.

8. The slicing machine cleaning guard as recited in claim 1 where said means for securing said rotary blade cover element includes:

(a) a slot insert member fixedly secured to said cover element, said slot insert member adapted for insert of an extension lug member extending from said housing of said slicing machine; and, (b) a threaded securement member fixedly secured to said cover element, said threaded securement member being coupled to a threaded opening formed in said housing of said slicing machine.

9. The slicing machine cleaning guard as recited in claim 8 where said slot insert member is mounted to a periphery of said cover element.

10. The slicing machine cleaning guard as recited in claim 1 where said means for securing said rotary blade includes at least one magnet member fixedly secured to said cover element, said magnet member for magnetically interfacing with said planar frontal cutting surface of said cutting blade.

* * * * *